United States Patent [19]

Balfanz

[11] 4,133,448

[45] Jan. 9, 1979

[54] OVERCAP FOR AEROSOL CONTAINER

[75] Inventor: Robert W. Balfanz, Racine, Wis.

[73] Assignee: S. C. Johnson & Son, Inc., Racine, Wis.

[21] Appl. No.: 801,133

[22] Filed: May 27, 1977

[51] Int. Cl.[2] ..... B65D 43/10

[52] U.S. Cl. ..... 220/306; 220/85 P

[58] Field of Search ..... 220/85 P, 284, 306, 220/307; 222/182, 541

[56] References Cited

U.S. PATENT DOCUMENTS

| | | | |
|---|---|---|---|
| 3,037,672 | 6/1962 | Gach | 220/85 P |
| 3,170,602 | 2/1965 | Suellentrop | 222/541 |
| 3,225,958 | 12/1965 | Frankenberg | 220/307 |
| 3,334,769 | 8/1967 | Gach | 220/284 |
| 3,647,107 | 3/1972 | LaGratta | 222/182 |
| 3,791,551 | 2/1974 | Madeira | 220/284 |

*Primary Examiner*—George E. Lowrance

[57] ABSTRACT

An overcap for engagement with the end of a cylindrical metal container, such as an aerosol container. The overcap has an enclosure portion and a circular lower edge portion for engaging the container. The lower edge portion is characterized by a radially inwardly extending annular ring at the lower edge which has an inner diameter less than the outer diameter of the snap bead which is formed in a dome of the container, a plurality of circumferentially spaced, crushable radial ribs extending outwardly from the annular ring sufficiently to interact with the container doubleseam when the annular ring is first snapped over the snap bead to "size" the overcap for engagement with the container, and a doubleseam-engaging flange extending radially outwardly from the enclosure and spaced above the annular ring in an axial direction by a distance about equal to the axial distance between the top of the doubleseam and the undercut which is formed in the container dome just below the snap bead.

4 Claims, 6 Drawing Figures

OVERCAP FOR AEROSOL CONTAINER

BACKGROUND OF THE INVENTION

This invention relates to covers, and, more particularly, to overcaps for pressurized or "aerosol" devices.

Aerosol containers typically have a cylindrical metal container body and a metal dome joined thereto by means of a circular doubleseam. An aerosol valve for dispensing the fluid contents of the container is typically mounted to the dome along the axis of the cylindrical metal container. It has been quite common to cover the domed end of an aerosol container and the dispensing valve attached thereto by means of a cover known as an overcap. Such overcaps typically snap over the doubleseam or over a snap bead which is normally formed in the dome somewhere near the cylindrical wall of the metal container body.

Such overcaps are typically made either of metal or, in some cases, of plastics such as polypropylene or high density polyethylene. Metal overcaps and plastic overcaps of the prior art have many significant disadvantages. Metal overcaps are often so rigid as to be quite difficult to remove them from engagement with an aerosol container. Furthermore, metal overcaps are known to be relatively expensive compared to overcaps made of plastic. Plastic overcaps, on the other hand, while being highly preferred from a cost standpoint, are often unacceptable for several other reasons.

Plastic overcaps, particularly overcaps for use on large-diameter aerosol containers (such as containers having diameters of 3.10 inches), are often susceptible to a retention problem in which the overcap is not firmly engaged with the aerosol container, allowing it to be easily dislodged. In some cases, while such plastic overcaps may be firmly engaged with the aerosol container in the initial capping, subsequent repetitive recapping during or between uses of the aerosol container will result in a breakdown in the attachment of overcap to aerosol container, making the attachment loose at best. This problem is often due to cold flow properties of the plastic materials used in such overcaps. Such cold flow characteristics may necessitate unreasonably tight dimensional tolerances in molding, which cannot be met in production. Tolerances which are achievable, on the other hand, have not consistently provided overcaps which may be attached firmly to aerosol containers.

This retention problem is exacerbated by top-loading forces which typically come to bear on the overcap, particularly during warehousing of finished aerosol products. Such excessive top-loading forces drive the overcap against the metal aerosol container thus tending to destroy the dimensioning which is essential to successful retention.

BRIEF SUMMARY OF THE INVENTION

This invention overcomes the aforementioned problems by providing an inexpensive overcap which is firmly and repetitively attachable to an aerosol container. The overcap is resistant to degradation of those dimensions which are critical for firm attachment to an aerosol container, even during application of severe top loading pressures. And, unlike some metal overcaps, the overcap of this invention may be removed from an aerosol container without difficulty.

The overcap of this invention has an enclosure portion, such as a cylindrical wall closed at one end, and a circular lower edge portion for engaging the end of a cylindrical metal container. (Throughout the descriptions herein, the terms "axial" and "radial" and the like refer to the axis and the radii of a cylindrical aerosol container and consider an overcap in position engaged therewith.) The lower edge portion has a radially inwardly extending annular ring having an inner diameter less than the outer diameter of the snap bead which is formed in the container dome. The annular ring snaps over the snap bead and into an undercut formed in the dome immediately below the snap bead. A plurality of circumferentially spaced ribs extend outwardly from the annular ring such that the distance in a radial direction between the inner edge of the annular ring and the outer end of a rib is greater than the distance in a radial direction between the undercut in the dome and the doubleseam connecting the dome to the cylindrical container body. A doubleseam-engaging flange extends radially outwardly from the enclosure at a position axially spaced above the annular ring by a distance about equal to the distance in an axial direction between the undercut and the top of the doubleseam.

OBJECTS OF THE INVENTION

An object of this invention is to provide an overcap for aerosol containers overcoming the aforementioned problems.

Another object of this invention is to provide an inexpensive plastic overcap for aerosol containers without the disadvantages of previous plastic overcaps.

Another object of this invention is to provide a plastic overcap which may be firmly retained on an aerosol container, including a container of large standard diameter, in spite of much repetitive use.

Yet another object of this invention is to provide a plastic overcap which is able to withstand severe top loading pressures without degradation of those dimensions which are critical to firm attachment to an aerosol container.

Still another object of this invention is to provide a plastic overcap for aerosol containers of large diameter which is both firmly attachable thereto yet readily removable therefrom.

BRIEF DESCRIPTION OF THE DRAWINGS

These and other objects of the invention will be apparent from the following description of preferred embodiments wherein.

DESCRIPTION OF PREFERRED EMBODIMENTS

Figure 1:
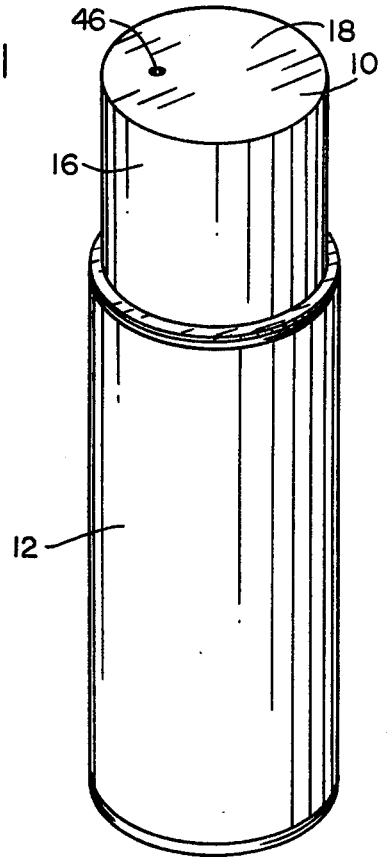
FIG. 1 is a perspective view of an aerosol container having an overcap according to this invention.

FIG. 1 illustrates an overcap 10 according to this invention attached to a cylindrical metal aerosol container 12. Overcap 10 has an enclosure portion 14 which consists of a cylindrical wall 16 and a flat end 18, and a circular lower edge portion 20 for engaging aerosol container 12.

Figure 3:
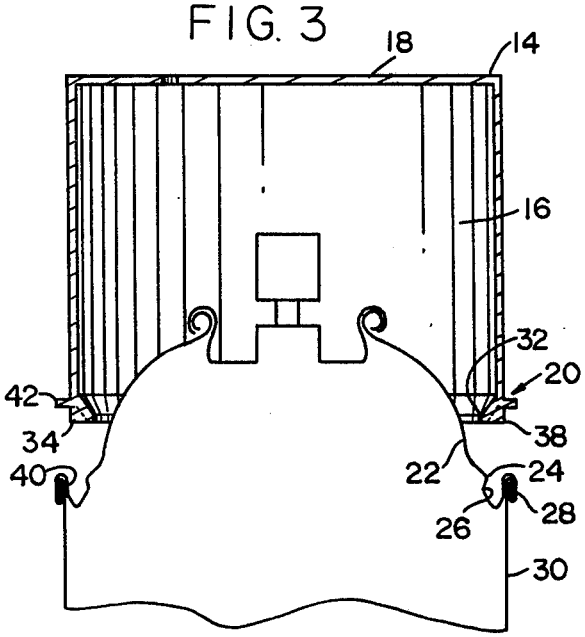
FIG. 3 is a side sectional view taken along section 3—3 as shown in FIG. 2 and further including a schematic outline of the domed end of an aerosol container to which the overcap is to be attached.

FIG. 3 illustrates important dimensions of aerosol container 12 which relate to the attachment of overcap 10 thereto. Container 12 has a snap lock dome 22 which is joined to cylindrical wall 30 at doubleseam 28. Dome 22 includes a snap bead 24 forming an undercut 26 which is radially spaced a first distance from the doubleseam 28, that is, from the inner surface 40 thereof. Undercut 26, that is, the portion thereof having the smallest radius, is axially spaced below the top 44 of doubleseam 28 by a fixed second distance. Such first and second fixed dimensions are important in choosing certain dimensions of the inventive overcap.

Overcap 10 has a radially inwardly extending annular ring 32 at its lower edge portion 20 which forms the bottom edge of overcap 10. Annular ring 32 has an inner diameter less than the outer diameter of snap bead 24 to facilitate the snap engagement of overcap 10 with container 12. The overcap is attached to the container by expansion of annular ring 32 to snap over snap bead 24 as overcap 10 is loaded onto dome 22. After snapping over snap bead 24, annular ring 32 fits into undercut 26.

Figure 2:
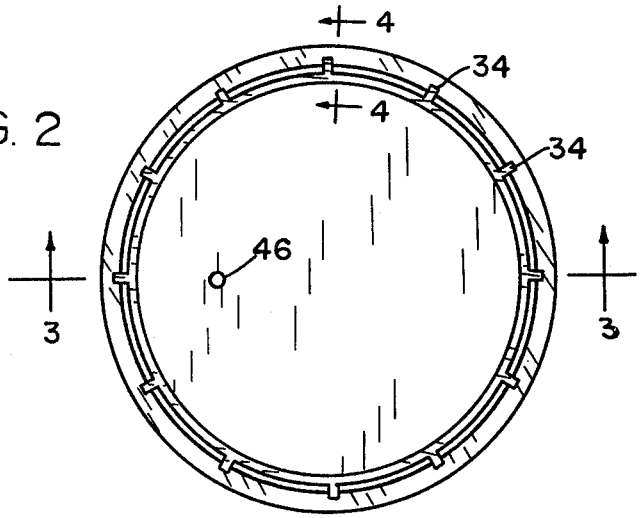
FIG. 2 is an enlarged bottom plan view of the overcap of FIG. 1.

As best illustrated in FIG. 2, overcap 10 has a plurality of circumferentially spaced radial ribs 34 extending radially outwardly from annular ring 32. Ribs 34 cooperate with the various other elements of this invention to allow an overcap to adjust to the dimensions of an aerosol container and form a firm attachment thereto. Ribs 34, which are flat pieces oriented in planes containing the axis of container 12, extend outwardly from annular ring 32 sufficiently such that the distance, in a radial direction, between the inner edge 36 of annular ring 32 and the outer ends 38 of ribs 34 is greater than the aforementioned first fixed distance (the radial dimension between undercut 26 and inner surface 40 of doubleseam 28).

Overcap 10 also includes an annular, doubleseam-engaging flange 42 which extends radially outwardly from enclosure 14, generally in a plane perpendicular to the axis of container 12. Flange 42 is spaced above annular ring 32 (that is, above the bottom edge of overcap 10), in an axial direction, by a distance roughly about equal the aforementioned second fixed distance (which is equal to the axial spacing between undercut 26 and top 44 of doubleseam 28). "About equal", as used herein, should not be narrowly construed. The term is intended to limit the dimensioning, specifically, the location of flange 42, only sufficiently to prevent excessive crushing and distortion of ribs 34 and annular ring 32 upon forceful loading of overcap 10 onto container 12. As such loading occurs, flange 42 engages top 44 of doubleseam 28 to prevent lower edge portion 20 of overcap 10 from being driven too far into the annular space defined between doubleseam 28 and dome 22.

As shown in the figures, it is highly preferred that ribs 34 extend in a plane from annular ring 32 outwardly a suitable distance, as previously mentioned, and upwardly to attach to the lower surface of flange 42. Such a configuration gives ribs 34 a suitable degree of strength and allows a controlled crushing thereof during the original attachment of overcap 10 to container 12. As shown in FIG. 2, it is highly preferred that there be many ribs spaced about the circumference of lower edge portion 20. While FIG. 2 shows twelve such ribs, a minimum of three ribs may be acceptable.

Overcap 10 is preferably made of a substantially rigid but somewhat flexible material such as various plastics. Polypropylene and high density polyethylene are highly preferred. Overcap 10 is preferably integrally molded by techniques well known to those skilled in the art.

Figure 4:
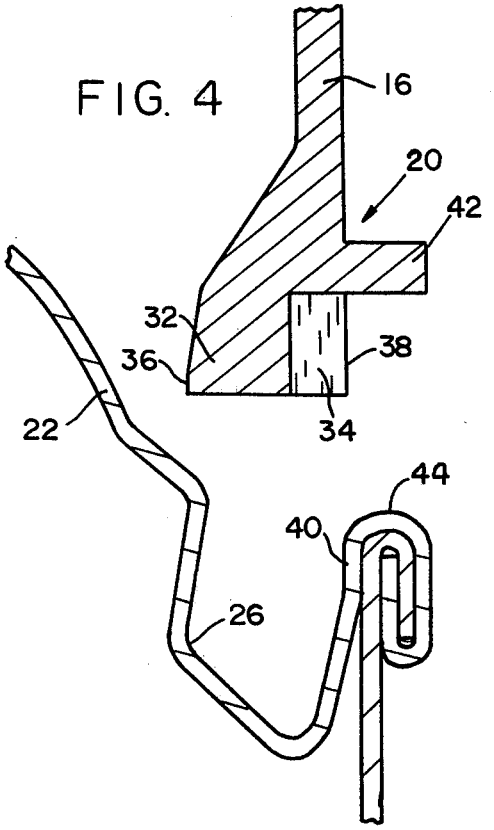
FIG. 4 is an enlarged partial sectional view taken along section 4—4 as shown in FIG. 2, showing details of the lower edge of the overcap of this invention.
Figure 5:
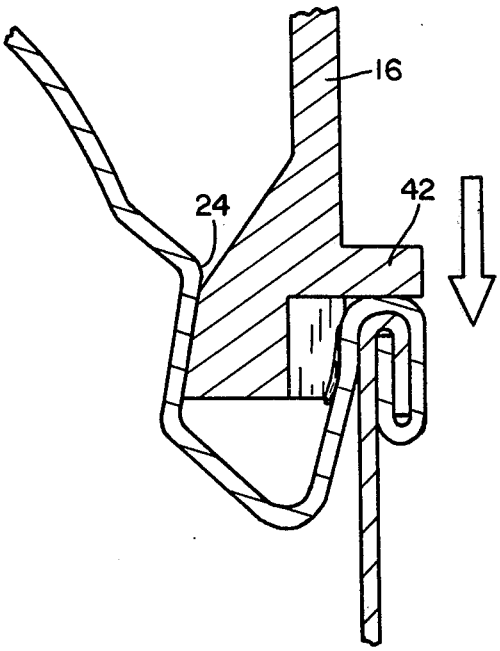
FIG. 5 is an enlarged partial sectional view as in FIG. 4 but showing the overcap after attachment to an aerosol container.
Figure 6:
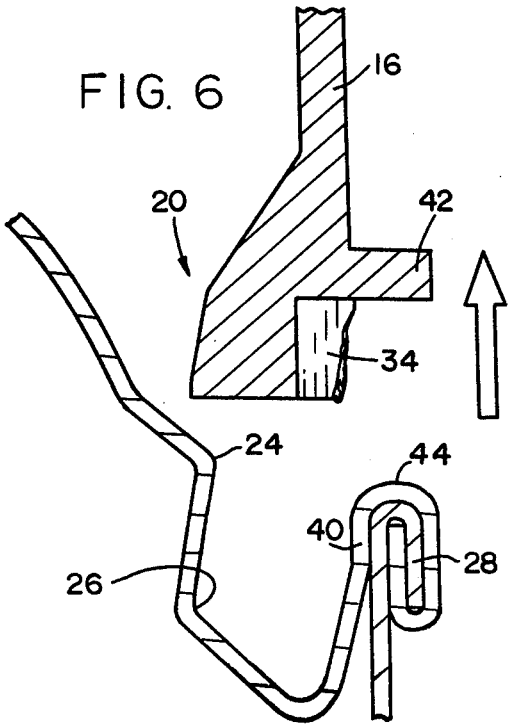
FIG. 6 is an enlarged partial sectional view as in FIGS. 4 and 5, showing the overcap of FIG. 5 after removal from the aerosol container.

FIGS. 4–6 illustrate the deformation which occurs in ribs 34 to allow overcap 10 to be sized for proper attachment to an aerosol container. Such sizing accomodates variations in overcap dimensions which are normal for plastic overcaps, including overcaps for large diameter aerosol containers.

FIG. 4 shows the configuration of lower edge portion 20 before overcap 10 is attached to an aerosol container. FIG. 5 illustrates the configuration of such lower edge portion 20 after overcap 10 has been loaded onto aerosol container 12. Rib 34 has been crushed to some extent as it has been pressed in the space separating snap bead 24 and undercut 26 from inner surface 40 of doubleseam 28. In most cases, several of the circumferentially spaced ribs 34 of an overcap 10 will be crushed to some extent when overcap 10 is loaded onto aerosol container 12. Such crushing, however, does not substantially change as the overcap is repetitively removed from and reattached to the aerosol container. The amount of crushing of ribs 34 is controlled by the presence of flange 42, which engages top 44 of doubleseam 28, thereby preventing the overcap from being pushed too far into engagement with the aerosol container.

FIG. 6 illustrates overcap 10 after removal thereof from attachment with container 12. Ribs 34 will remain deformed as the overcap has been permanently sized for use with the aerosol container to which it was originally attached. Slight additional deformations will occur, but the overcap will be firmly attachable to its container even after substantial use.

FIG. 3 shows a vent aperture 46 defined in flat end 18 of overcap 10. Aperture 46 prevents excessive air pressure from interfering with capping of an aerosol container by venting air therefrom as the overcap is attached to the container. Such vent, which could be anywhere on enclosure 14, forms no part of this invention.

While in the foregoing specification, this invention has been described in relation to certain preferred embodiments, and many details have been set forth for purpose of illustration, it will be apparent to those skilled in the art that the invention is susceptible to additional embodiments and that certain of the details described herein can be varied considerably without departing from the basic principles of the invention.

I claim:

1. A container and overcap combination comprising:

a container of the type having a snap lock dome and a cylindrical container body joined together by a circular doubleseam, said dome having a radially protruding snap bead forming an undercut radially spaced a first distance from said doubleseam, said undercut being axially spaced a second distance below the top of the doubleseam; and an overcap engaged with said container, said engaged overcap comprising:

an enclosure having a circular lower edge;

a radially inwardly extending annular ring near said lower edge, said ring having an inner edge with an inner diameter less than the outer diameter of said snap bead, said inner edge being received in said undercut;

a plurality of circumferentially spaced radial ribs, said ribs being substantially parallel to the axis of said cylindrical container body and extending radially outwardly from the annular ring to outer ends engaging said doubleseam, such that the distance in a radial direction between the inner edge of the annular ring and the outer ends of said ribs is substantially equal to said first distance, at least some of said ribs being deformed at their outer ends by engagement with said doubleseam; and a doubleseam-engaging flange extending radially outwardly from said enclosure, said flange axially spaced above said ring by a distance about equal said second distance and engaging the top of the doubleseam whereby to limit the loading of said overcap onto said container.

2. The overcap of claim 1 integrally molded in plastic.

3. The overcap of claim 1 wherein said ribs extend between said annular ring and said flange and are attached to said flange.

4. The overcap of claim 3 integrally molded in plastic.

* * * * *